United States Patent [19]

Krob et al.

[11] 4,352,507

[45] Oct. 5, 1982

[54] SOLE-SUPPORT MECHANISM

[75] Inventors: Erwin Krob, Vienna; Josef Svoboda, Schwechat, both of Austria

[73] Assignee: TMC Corporation, Baar, Switzerland

[21] Appl. No.: 247,693

[22] Filed: Mar. 26, 1981

Related U.S. Application Data

[62] Division of Ser. No. 55,337, Jul. 6, 1979, Pat. No. 4,288,093.

[30] Foreign Application Priority Data

Jul. 7, 1978 [AT] Austria ..... 4928/78

[51] Int. Cl.[3] ..... A63C 11/00

[52] U.S. Cl. ..... 280/605; 280/636

[58] Field of Search ..... 280/605, 636, 611, 631, 280/633, 629, 604

[56] References Cited

U.S. PATENT DOCUMENTS

| | | | |
|---|---|---|---|
| 3,446,511 | 5/1969 | Marker | 280/636 |
| 3,799,563 | 3/1974 | Smolka et al. | 280/636 |
| 3,950,000 | 4/1976 | Sittmann | 280/636 |
| 4,022,493 | 5/1977 | Weigl et al. | 280/633 |
| 4,138,136 | 2/1979 | Riedel | 280/605 |

FOREIGN PATENT DOCUMENTS

| | | | |
|---|---|---|---|
| 556674 | 10/1976 | Switzerland | 280/633 |

*Primary Examiner*—Joseph F. Peters, Jr.
*Assistant Examiner*—Michael Mar
*Attorney, Agent, or Firm*—Blanchard, Flynn, Thiel, Boutell & Tanis

[57] ABSTRACT

A sole-support mechanism having a stepping plate for the heel of a ski boot which is urged by a spring-loaded ski binding part, in particular by a heel holder, toward a front jaw which forms a ski-fixed support in longitudinal direction of the ski, and is supported on a guide plate, which plate is movable in longitudinal direction of the ski through the force of at least one thrust spring over a holding rail or the like, wherein the upper side of the sole-support mechanism consists, if desired, of a material which has a low friction coefficient or has a layer of such a material.

8 Claims, 14 Drawing Figures

SOLE-SUPPORT MECHANISM

This application is a division of application Ser. No. 55,337, filed July 6, 1979, now U.S. Pat. No. 4,288,093, Sept. 8, 1981.

FIELD OF THE INVENTION

This invention relates to a sole support for the sole of a ski boot and, more particularly, to a sole support which will facilitate a compensation for the change in the spacing of the ski binding components in response to a flexing of a ski.

BACKGROUND OF THE INVENTION

A sole-support mechanism of the above-mentioned type is described for example in Austrian Pat. No. 302,128 (corresponds to U.S. Pat. No. 3,799,563). Substantially truncated-cone-shaped plates are supported in this conventional construction rotatably about axes which are positioned at an obtuse angle with respect to the upper surface of the ski. The truncated-cone shape is thereby chosen such that the region on which the ski boot sole will lie extends parallel with respect to the upper surface of the ski. The plates permit the reduction of the friction forces during a release operation between the sole-support mechanism and the ski boot. The sole-support mechanism is rigidly connected to the ski viewed in longitudinal direction of the ski. Thus, due to the bending of the ski, a disadvantageous relative movement occurs between the sole-support mechanism and the ski boot. This results in wear of the ski boot sole and during uncontrolled occurrences of friction a nonexact release.

According to Austrian Pat. No. 273,755 (corresponds to U.S. Pat. No. 3,446,511), it is also known to connect a preferably circularly constructed sole-support plate by means of a boltlike element to a hold-down plate arranged in an elongated recess which extends parallel with respect to the upper surface of the ski. The elongated recess is provided in a guide plate which grips on all sides around the hold-down plate. Between the boltlike elements and the edge of the opening of the guide plate and between the hold-down plate and the inner edge of the recess of the guide plate there is provided a spacing on all sides and between the hold-down plate and the inner edge of the recess of the guide plate there is arranged on all sides an elastic return mechanism.

Even though in this exemplary embodiment the sole-support plate can undergo a limited amount of movement, which a ski boot carries out, still a disadvantageous relative movement which wears the ski boot occurs between ski boot and sole-support plate.

The goal of the invention is to avoid the mentioned and further disadvantages of these conventional constructions and to produce a sole-support mechanism of the above-mentioned type, in which a relative movement does not occur preferably in longitudinal direction of the ski between the ski boot and the sole support, as this is usually the case during a flexing of the ski, caused by the thrust compensation.

The set purpose is inventively attained by the stepping plate being connected without movement capability in the longitudinal direction of the ski relative to the guide plate.

The inventive construction of the sole-support mechanism facilitates an achievement of all goals. The entire sole-support mechanism does not carry out any relative movement with respect to the ski boot in direction of the longitudinal axis of the ski; however, the swivelling movements of the ski boot can be performed as needed by the rotatable plate or swingable plate.

A particularly preferable embodiment of the invention is characterized by the stepping plate, as is actually known, being constructed at least partially as a rotatable disk or swingable plate, which disk or plate, loaded by the thrust springs, is held pressed into the normal position and is centered.

A different embodiment of the invention is characterized by the guide plate being loaded at least by one, preferably by two tension springs, which is or are suspended at one end in the guide plate and at the other end on a bent section of the axle of a ski brake and thus effects or effect both the thrust compensation and also an erecting of the ski brake.

BRIEF DESCRIPTION OF THE DRAWINGS

Further details, advantages and characteristics of the invention will be described more in detail with reference to the drawings, which illustrate several exemplary embodiments.

In the drawings:

FIGS. 7 and 8 illustrate a different exemplary embodiment of a sole-support plate with a ski brake, wherein FIG. 7 is a side view and FIG. 8 a top view;

DETAILED DESCRIPTION

Figure 1:
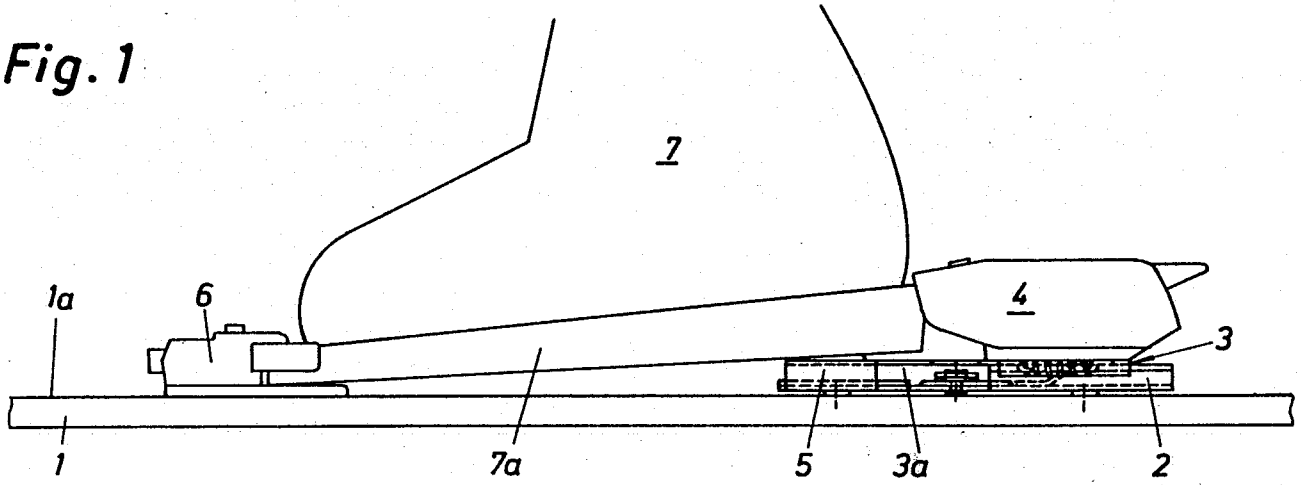
FIG. 1 is a side view of the arrangement of an inventive sole-support plate on a ski having a safety ski binding which consists of a front and rear jaw and a ski boot which is held in the safety binding.
Figure 2:
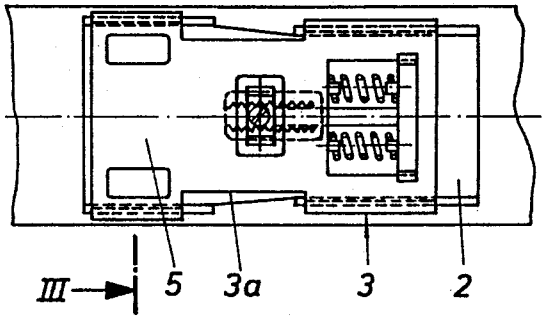
FIG. 2 is the top view of the sole-support plate.
Figure 3:
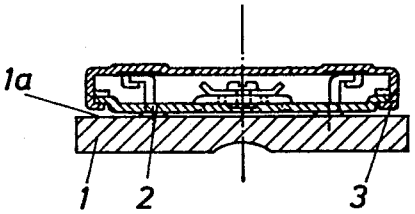
FIG. 3 is a cross-sectional view taken along the line III—III of FIG. 2.

Parts, which do not concern the actual subject matter of the invention, will be identified and described only in the following description insofar as they are needed for understanding the subject matter of the invention.

As will be recognized from the first exemplary embodiment according to FIGS. 1 to 4, a guide rail 2 is fastened to the upper surface 1*a* of a ski 1 for example by means of not illustrated screws and serves to guide a guide plate 3 of a heel holder 4 of a safety ski binding. To facilitate a better understanding of the invention, the heel holder 4 was omitted from FIGS. 2 and 3, so that a view of the design of the guide plate 3 would be possible. The guide plate 3 differs from common plates of this type because it has a stepping plate segment 5 located in a direction toward the tip of the ski. The stepping plate segment 5 is wider than is the remaining area of the guide plate 3 and is slightly offset from the remainder area through a rectangular necked-down portion 3*a*.

A ski boot 7 is held clamped between the heel holder 4 and a front jaw 6 of any desired release construction. Springs which are arranged in the guide plate 3 urge the ski boot 7 through the heel holder 4 toward and against the front jaw 6. Since a biassing of the guide plate 3 by coil springs which are not identified in detail is actually known and not important for the invention, these parts are not discussed in any further detail.

Figure 4:
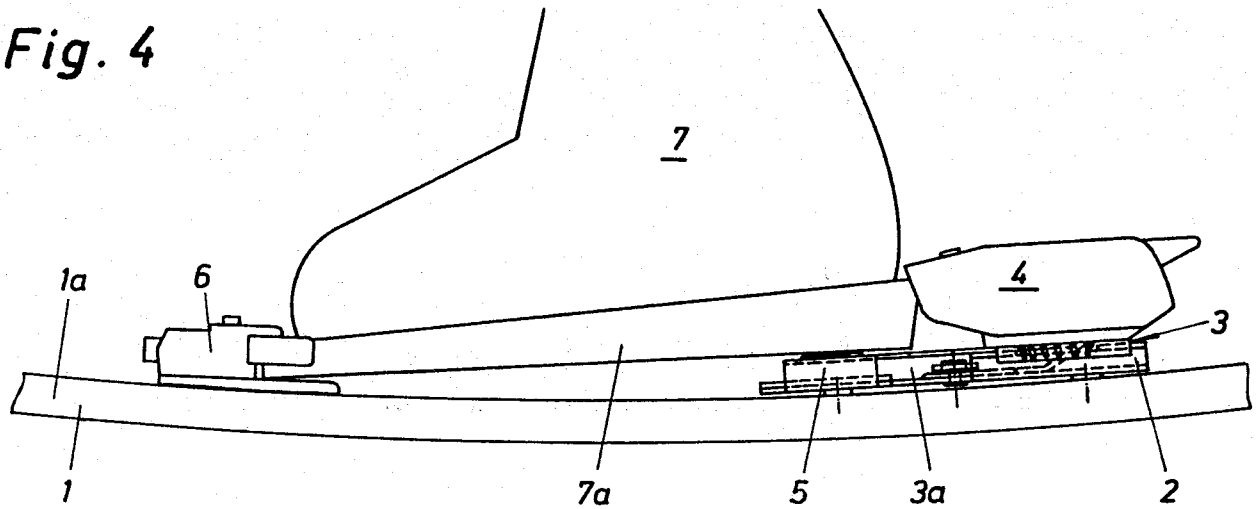
FIG. 4 is a side view similar to FIG. 1, with the ski bent.

During a bending of the ski 1, the sole 7*a* of the ski boot 7, as viewed from the side in FIG. 4, becomes oriented on a chord of the arc defined by the ski. Since the ski boot 7 is supported with its tip on the front jaw 6, which is not movable relative to the ski in a longitudinal direction of the ski, the entire length change, which is caused by the bending of the ski, must be absorbed by the heel holder 4 mounted on the guide plate 3 which slides on the guide rail 2. This can clearly be seen by comparing the two positions of the guide plate 3 illustrated in FIGS. 1 and 4. Furthermore, one can recognize from FIG. 4 that no relative movement at all occurs between an extension 3*a* designed in one piece with the guide plate 3, the stepping plate segment 5 and the heel of the ski boot 7 at the one end and the heel holder 4 at the other end. Only the position which the sole 7*a* of the ski booth 7 assumes on the stepping plate segment 5 is changed slightly. This change is indicated by the difference between the complete support of the ski boot 7 on the stepping plate segment 5 shown in FIG. 1 and the partial support of the ski boot in FIG. 4, which is slightly elevated above the front region of the stepping plate segment 5.

Figure 5:
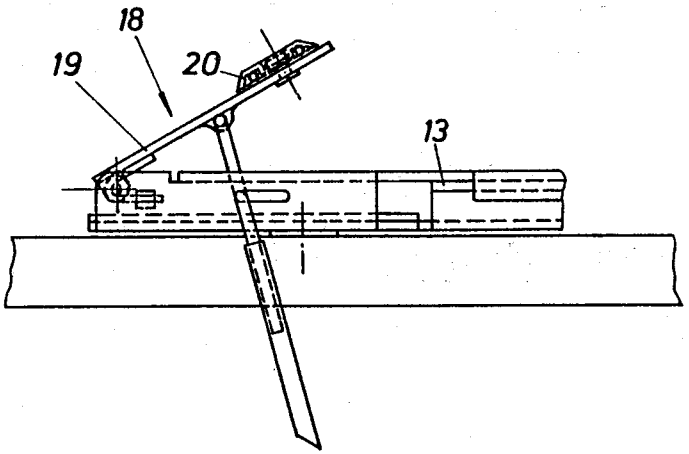
FIG. 5 is a side view of a sole-support plate in association with a ski brake.
Figure 6:
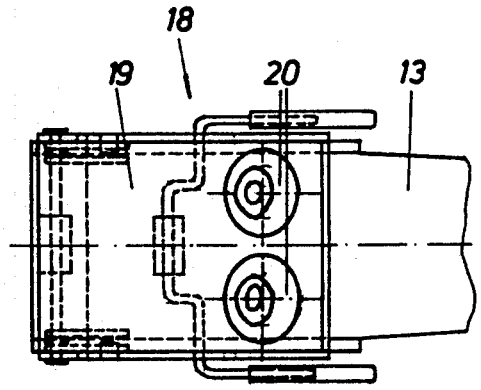
FIG. 6 is a top view of FIG. 5.

In the exemplary embodiment according to FIGS. 5 and 6, a guide plate 13 is constructed such that it can pivotally support a pedal 19 of a ski brake 18. The pedal 19 is spring urged to the erected position to simultaneously cause the brake arms to move to the braking position. The end of the pedal 19 of the ski brake 18, which end is adjacent the heel holder (here not illustrated), has two sliding disks 20 on its upper side which reduce during a lateral or during a simultaneous vertical and lateral release of the heel holding safety ski binding and in the region of the heel of the ski boot, also not shown, the friction between the ski boot sole (see 7*a* in FIG. 1) and the pedal 19. The two sliding or rotating disks 20 are of a conventional construction; they are arranged symmetrically with respect to the longitudinal axis of the pedal 19 (See U.S. Pat. No. 3,511,516 for a similar construction of the disks).

Figure 7:
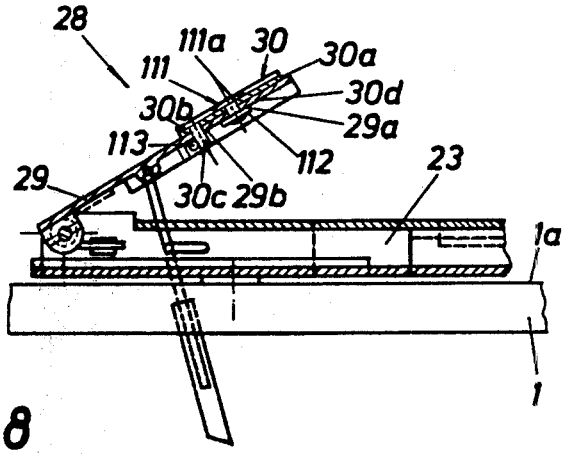
Figure 8:
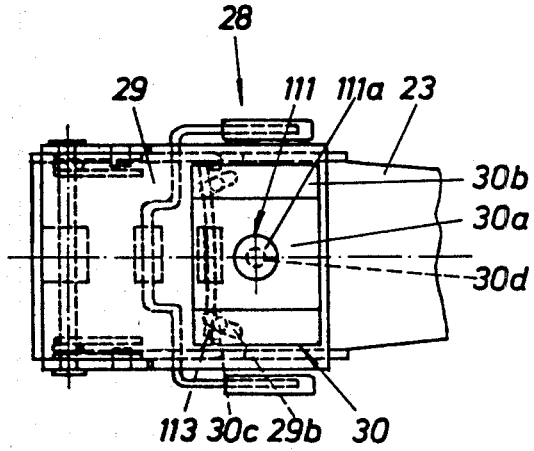

The sole-support mechanism according to the exemplary embodiment which is illustrated in FIGS. 7 and 8 corresponds in design substantially with the exemplary embodiment according to FIGS. 5 and 6 with the difference that in place of the two sliding or rotating disks 20, a swivel plate 30 is used. The swivel plate 30 has in its central region a depressed portion 30*a*, which central region is flanked by two side portions 30*b*. The two side portions 30*b* each have on their underside in the area of the edge facing the tip of the ski, cylindrical pins 30*c*, the axes of which are positioned perpendicularly to the plane of the swivel plate 30. The depressed portion 30*a* of the swivel plate 30 has approximately in its center an opening 30*d* therethrough. Also approximately in the region of the longitudinal axis of the pedal 29 of the ski brake 28 there is provided an opening 29*a* having the same diameter as in the swivel plate 30. The swivel plate 30 is pivotally connected to the pedal 29 with the aid of a connecting bolt 111. The connecting bolt 111 has a cylindrical head 111*a* and penetrates thereby through the opening 30*d* of the swivel plate 30 and terminates flush with the upper surface of the side portions 30*b*. Furthermore, the connecting bolt 111 extends through the opening 29*a* in the pedal 29 prior to it being riveted thereto with the interpositioning of a washer 112 to thereby prevent a removal of the swivel plate 30 from the pedal 29.

Each cylindrical pin 30*c* projects into an arcuate slot 29*b* of the pedal 29, which slot is concentric with respect to the central axis of the opening 29*a*. The two pins 30*c* are biassed by a spring-steel wire 113 arranged in the pedal 29 transversely with respect to the longitudinal axis of the ski and is initially tensioned in direction of the two pins 30*c*, so that the swivel plate 30 is always urged into the normal position according to FIGS. 7 and 8. Thus, it is possible for the swivel plate 30 to slightly swing or pivot during a safety release of the ski boot (not shown here) in the clockwise and counterclockwise directions; after the ski boot is freed, the swivel plate 30 is automatically returned by the spring wire 113 into the stepping-in position for the ski boot.

Figures 9, 10, 11, 12:
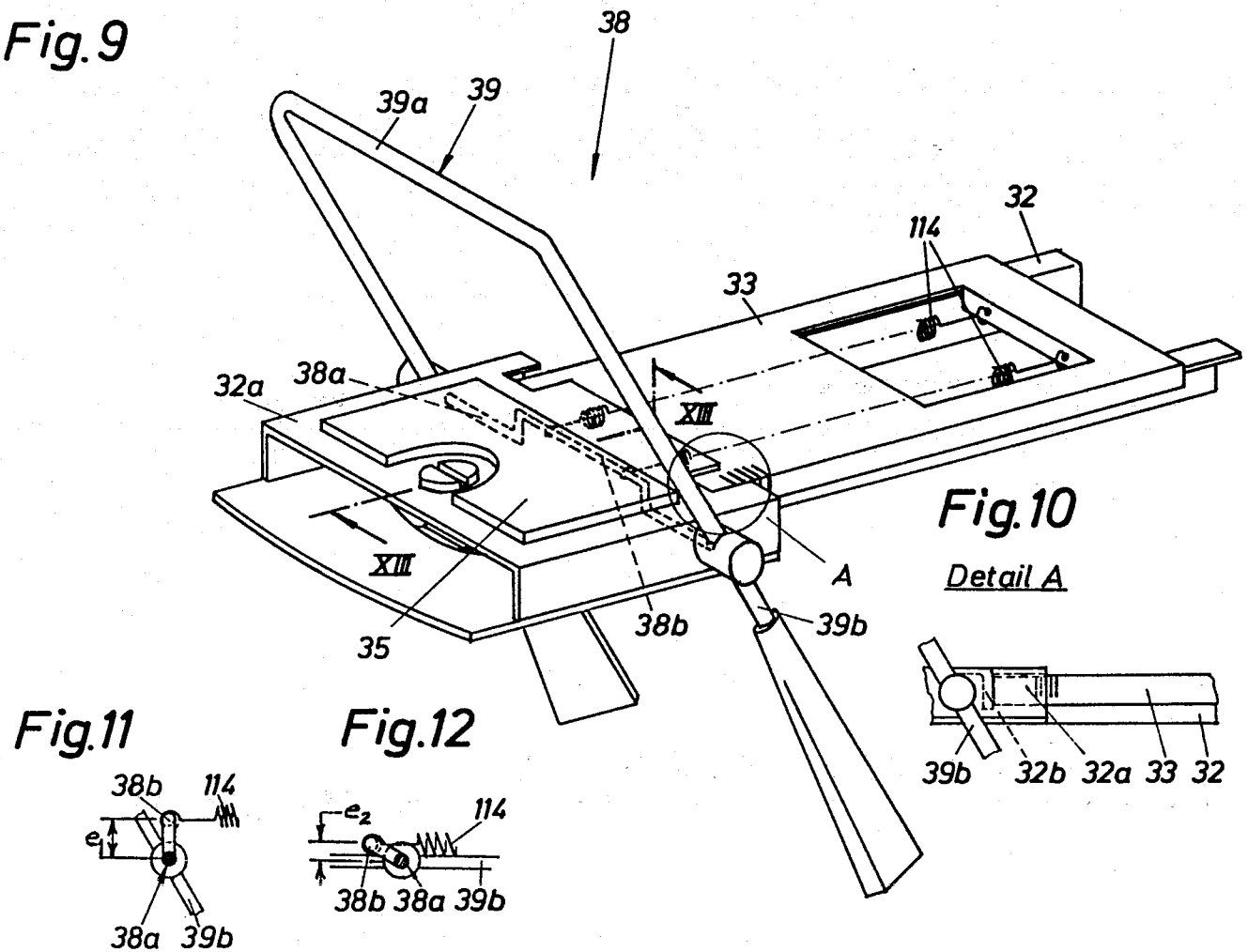
FIG. 9 is a perspective view of a further inventive sole-support plate having an integrated ski brake.
FIG. 10 is a side view of an encircled detail (A) in FIG. 9.
FIGS. 11 and 12 schematically illustrate the action of the spring which biasses the ski brake about the axis of the ski brake, according to FIG. 9, and in the braking and in the retracted position, respectively.

In the exemplary embodiment according to FIG. 9, the guide rail 32 has an elevated portion 32*a*. The elevated portion 32*a* is used to receive the pivot axle 38*a* of a ski brake 38. The axle 38*a* of the ski brake 38 has a bent segment 38*b*. Each end of two tension springs 114 is hooked on the bent segment 38*b*. The other ends of the tension springs 114 are anchored in the guide plate 33. The two tension springs 114 thus do not only cause the guide plate 33 to be pulled into the normal position, but also an erecting of the ski brake 38. A substantially rectangular stepping plate 35 of uniform thickness is provided on the elevated part 32*a*. The connection between the stepping plate 35 and the guide plate 33, which is designed such that a relative movement does not occur between these two structural parts, will be described below in more detail. The elevated portion 32*a* is fixedly connected to the guide rail 32 and relative to the ski by means of a conventional, arbitrarily releasable locking mechanism, which is not important for the invention.

The ski brake 38 has a substantially U-shaped bar with a portion thereof functioning as a pedal 39, which part is formed substantially by a bight segment 39*a* of the bar. In order to prevent a damaging of the ski boot sole during operation of the pedal 39, it is possible to provide the bight segment 39*a* of the pedal 39 with a cylindrical sleeve (not shown) which is rotatable about said bight segment.

FIG. 10 illustrates the stop 32*b* for the guide plate 33, which is bent out of the elevated part 32*a*. FIG. 11 illustrates the position of the two braking legs 39*b* of the pedal 39 with respect to the bent portion 38*b*. In this position of the ski brake 38 (braking position), the effective lever arm is the greatest in relationship to the longitudinal axis of the tension springs 114 which engage the bent segment 38*b*. The effective length of the lever arm is $e_1$.

FIG. 12 indicates the position of the ski brake 38 in a stepped-down condition, namely in the retracted position. As a result, the effective length of the lever arm which is decisive for generating a torque shrinks to the distance $e_2$. Thus, in the retracted position of the ski brake 38, the force which is applied by the pedal 39 onto the ski boot becomes substantially smaller than the force which holds the ski brake 38 in the braking position. Thus, the force which pushes up on the sole of the ski boot in the retracted position of the ski brake 38 is also smaller.

Figure 13:
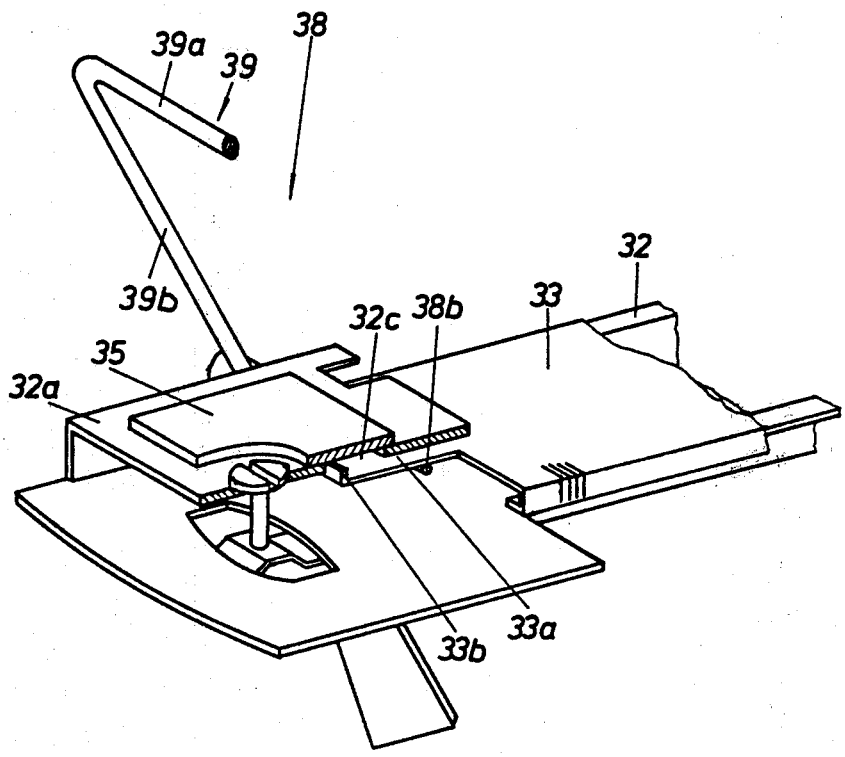
FIG. 13 is an elevational view of the sole-support plate taken along the line XIII—XIII of FIG. 9.

The connection between the stepping plate 35 and the guide plate 33 can be recognized in the partially sectioned illustration according to FIG. 13.

The guide plate 33 has approximately in its center on the end adjacent the stepping plate 35 a tongue-like extension 33*a* of a length which will yet be described in more detail. The extension 33*a* has at its free end an approximately right angle bent section 33*b* extending in a direction toward the stepping plate 35. The bent section 33*b* extends through a rectangularly-shaped recess 32*c* in the elevated portion 32*a* and is slightly wider than the extension 33*a*.

The extension 33*a* is sufficiently long that its bent section 33*b*, in the frontmost (right) position of the guide plate 33, namely when the guide plate stands at the two stops 32*b*, almost rests against the edge of the recess 32*c*, which edge is remote from the guide plate 33. The bent section 33*b* is fixedly connected to the stepping plate 35.

Figure 14:
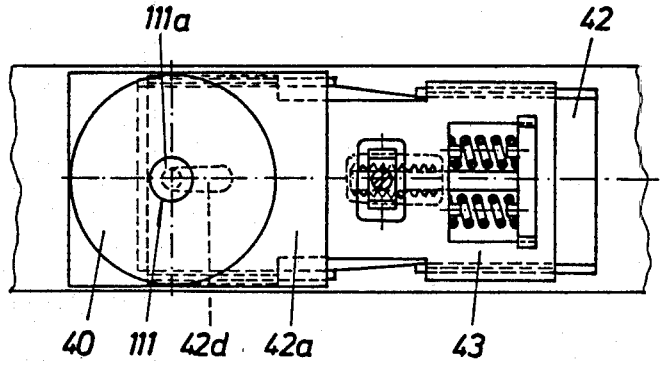
FIG. 14 illustrates a different exemplary embodiment of a sole-support plate which can be rotated about an axis.

The guide plate 43 has in the exemplary embodiment according to FIG. 14, in the region of its end remote from the thrust springs (left end), a cylindrical connecting bolt 111, the axis of which extends perpendicularly to the longitudinal axes of said thrust springs. The guide plate 43 is in this area gripped over by an elevated portion 42*a* of the guide rail 42. The elevated portion 42*a* is provided with a slot 42*d* which extends parallel with respect to the longitudinal axis of the ski and receives the connecting bolt 111 therein adjacent the central longitudinal axis of the ski. The slot 42*d* limits at the same time also the maximum possible stroke for the guide plate 43. The connecting bolt 111 carries above the elevated portion 42*a* a rotary plate 40. The rotary plate 40 which is rotatably supported on the connecting bolt 111 is secured against loss by an enlarged head 111*a* which is provided on the connecting bolt 111. Pressure springs are used for balancing the thrust in this exemplary embodiment, as this has been indicated as actually known already in connection with FIG. 2.

During a safety release of a ski boot (not illustrated) in the region of the heel, the rotary plate 40 can carry out a rotary movement about the axis of the tibia bone. Just like in the preceding exemplary embodiments, however, there exists during a bending of the ski no relative movement at all between the rotary plate 40 and the ski boot.

The invention is not limited to the illustrated exemplary embodiments. Further modifications can be carried out without departing from the scope of the invention. Of the described embodiments, one will choose those which appear most advantageous in connection with the existing ski binding. For example, it would be possible to design the stepping plate, which is constructed out of the guide plate in relationship to the remaining guide plate, not only wider but also more narrow. Also it is conceivable that the portion of the guide plate which forms the stepping plate is added without a necked-down portion to the remaining guide plate area. Also a difference in height between the stepping plate and the remaining guide plate area would be conceivable. The friction reducing devices, as a sliding disk and a swivel plate, could also be arranged on the stepping plate in a manner which differs from the ones described above. Also it is conceivable to use between the swivel plate and the stepping plate an intermediate part of a material which has a low friction coefficient characteristic, for example of polytetrafluoroethylene, known by the name Teflon. Also it would be possible to provide the swivel plate on its underside with a Teflon coating.

Also it would be conceivable to arrange the bent portion of the axle of the ski brake in the opposite direction and to use in place of the tension springs compression springs. It is also possible to connect the stepping plate not rigidly, but arbitrarily releasably, to the guide plate.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A sole support mechanism for the sole of a ski boot secured to a ski between a toe jaw and a heel holder, comprising:

guide rail means adapted to be mounted on said ski;

guide plate means mounted for reciprocal movement on said guide rail means, said heel holder being fixedly mounted on said guide plate means for movement therewith, said heel holder including means adapted to engage and hold said sole of said ski boot;

first resilient means operatively connected to said guide plate means and said guide rail means for urging said guide plate means toward said toe jaw; and stepping plate means on said guide plate means for supporting the heel portion of the sole of said ski boot during changes in the spacing between said toe jaw and said heel holder in response to a flexing of said ski with no relative longitudinal movement occurring between the sole of said ski boot and said stepping plate means, said stepping plate means including a ski brake pedal supported for movement between a braking position and a retracted position and including means on the upper side of said pedal for reducing friction between said pedal and the sole of said ski boot.

2. The sole support mechanism of claim 1, wherein said friction reducing means includes at least one truncated-conelike sliding disk supported on said pedal for pivotal movement about a first axis.

3. The sole support mechanism of claim 2, wherein said first axis is inclined to the vertical with respect to the upper side of said ski in the retracted position of said pedal, whereby the sole of said ski boot contacts a generatrix of said cone-shaped disk.

4. The sole support mechanism of claim 2, wherein a pair of said disks are arranged on said pedal symmetrically with respect to the longitudinal axis of said ski.

5. The sole support mechanism of claim 1, wherein said friction reducing means includes a swivel plate supported on said pedal for a limited range of pivotal movement about a first axis.

6. The sole support mechanism of claim 5, wherein said pedal has a pair of spaced arcuate slots lying on a circle concentric with said first axis, wherein said swivel plate has a concave central portion and has side portions flanking said central portion, and including a pin on the underside of and substantially perpendicular to each said side portion of said swivel plate, each said pin projecting into a respective said arcuate slot in said pedal.

7. The sole support mechanism of claim 6, including second resilient means for urging said swivel plate to a normal position substantially in the center of said limited range of pivotal movement.

8. The sole support mechanism of claim 7, wherein said second resilient means is a spring steel wire supported on said pedal, extending transversely of the longitudinal axis of said ski, and engaging said pins.

* * * * *